US007165960B2

(12) United States Patent
Bambi et al.

(10) Patent No.: US 7,165,960 B2
(45) Date of Patent: Jan. 23, 2007

(54) SINGLE MOLD MACHINE FOR PRESSURE CASTING SANITARY WARES

(75) Inventors: Domenico Bambi, Budrio (IT); Giorgio Sarani, Borgo Tossignano (IT)

(73) Assignee: Sacmi Cooperative Meccanici Imola Soc. Coop., Imola (IT)

( * ) Notice: Subject to any disclaimer, the term of this patent is extended or adjusted under 35 U.S.C. 154(b) by 245 days.

(21) Appl. No.: 10/670,468

(22) Filed: Sep. 26, 2003

(65) Prior Publication Data

US 2004/0075199 A1 Apr. 22, 2004

(30) Foreign Application Priority Data

Sep. 30, 2002 (IT) ..... BO2002A0618

(51) Int. Cl.
*B28B 7/08* (2006.01)

(52) U.S. Cl. ..... 425/183; 425/185; 425/195; 425/408; 425/450.1

(58) Field of Classification Search ..... 425/84, 425/183, 185, 348, 357, 408, 439, 450.1, 425/195
See application file for complete search history.

(56) References Cited

U.S. PATENT DOCUMENTS 4,363,619 A * 12/1982 Farrell ..... 425/525
5,817,345 A * 10/1998 Koch et al. ..... 425/130
6,113,382 A * 9/2000 McNally ..... 425/589
6,514,452 B1 * 2/2003 Maier ..... 264/542
6,613,262 B1 * 9/2003 Arend ..... 264/255

FOREIGN PATENT DOCUMENTS

| | | |
|---|---|---|
| DE | 42 25 919 C1 | 12/1993 |
| EP | 0 554 068 A1 | 8/1993 |
| GB | 1 295 055 | 11/1972 |

* cited by examiner

*Primary Examiner*—Donald Heckenberg
(74) *Attorney, Agent, or Firm*—Squire, Sanders & Dempsey L.L.P.

(57) ABSTRACT

Sanitary wares are pressure-cast on a single mold machine comprising a bed and two platens associated with the bed, each one supporting a respective mold half; one of the two platens is translatable along the bed in a longitudinal direction, whilst the other incorporates a tilting platen carrying the respective mold half and is rotatable about a horizontal axis extending perpendicular to the longitudinal direction; the accessibility to the mold halves and to the casting are improved and therefore the operations of demolding the green wares and transferring them to successive stages of manufacture are much facilitated, as also is the procedure for changing the mold.

10 Claims, 3 Drawing Sheets

SINGLE MOLD MACHINE FOR PRESSURE CASTING SANITARY WARES

BACKGROUND OF THE INVENTION

The present invention relates to a single mold machine for pressure casting sanitary wares.

More exactly, the present invention relates to a machine equipped with a single mold split into two halves and positioned vertically during operation, used in the manufacture of pressure cast sanitary wares such as shower bases, wash basins, flushing cisterns, basin pedestals and the like.

Sanitary wares of this type need to be cast with the halves of the mold positioned vertically, and the shapes are such that the pieces can be produced without difficulty using a mold composed of two parts. Such wares do not generally present undercut profiles, moreover, and therefore can be released from the mold halves with relative ease.

Conversely, the wares in question are typified by a structure that will be comparatively slender at least in one dimension, and accordingly, certain precautions must be taken when releasing them from the mold halves and transferring them to further manufacturing steps.

Sanitary wares, characteristically, are "green" when demolded: that is to say, the castings emerge with only a hint of firmness and limited mechanical strength, barely able to stand unsupported.

During the steps of demolding and subsequent transfer, any stresses greater than the mechanical strength of the green body can occasion irreparable damage to the sanitary ware, which will then have to be rejected.

The prior art embraces single mold machines for casting sanitary wares, in which the single mold presents a first mold half mounted to a stationary platen, and a second mold half mounted to a moving platen that is translatable while remaining in a plane parallel to the stationary platen, or at all events capable of rotating through 90° between the two steps of the casting cycle in such a way that the platen carrying one of the mold halves can be maneuvered into a horizontal position.

It has been found that these machines are not altogether satisfactory in operation, since the platens carrying the mold halves remain incapable of certain movements that would facilitate the release of the wares from the mold, whilst access both to the mold halves and to the casting tends to be difficult.

Similarly, the operation of replacing the mold tends to be somewhat slow and laborious.

A first object of the invention is to provide an improved single mold machine for pressure casting sanitary wares, such as will facilitate the steps whereby the casting is demolded and transferred to successive manufacturing operations.

A further object of the invention is to provide a single mold pressure casting machine designed so as to allow a swift changeover of the mold and thus minimize the down time incurred.

SUMMARY OF THE INVENTION

The stated objects are realized according to the present invention in a single mold machine for pressure casting sanitary wares, comprising a bed having a substantially longitudinal direction, a first and a second platen associated with the bed, two mold half supported respectively by the first and second platen, said first platen being translatable relative to the bed along the substantially longitudinal direction, and the second platen comprising a frame divided into two parts; each of said two parts being "L" shaped and comprising a first end portion directly constrained to the bed and a second end portion suspended from the bed and extending towards the first platen; the second platen further comprising a tilting platen carrying one of said two mold half; said tilting platen being placed between said two parts of the frame and being rotatable connected to said second end portions of the two parts, for rotating about an axis substantially horizontal and extending perpendicular to the longitudinal direction.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
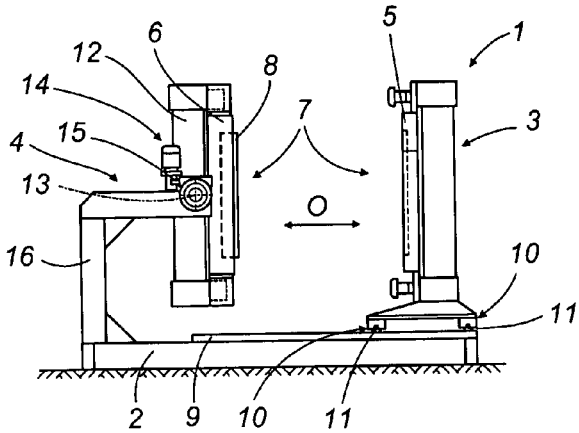
FIG. 1 shows the single mold machine according to the invention, viewed in a side elevation and illustrated in an open configuration.

With reference to the drawings, the invention relates to a single mold machine, denoted 1 in its entirety, for pressure casting sanitary wares.

The machine 1 appears substantially as a bed 2 with two platens 3 and 4, each serving to carry one relative half 5 and 6 of a mold in which to cast an item of sanitary ware 8.

Figure 8:
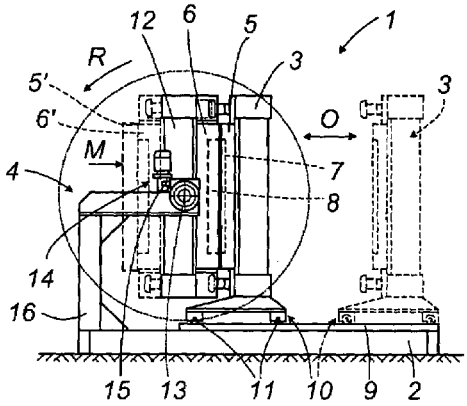
FIGS. 8 and 9 are side elevations showing two alternative embodiments of the single mold machine according to the invention.

The two mold halves 5 and 6 are able to assume relative positions distanced one from another as illustrated by way of example in FIG. 1, in which the machine 1 is open, and a position of mutual contact, illustrated by way of example in FIG. 8, in which the machine 1 is closed.

When the mold halves 5 and 6 are made to assume the position of mutual contact, they combine to create a cavity 7 into which a ceramic mixture, or "slip", can be directed forcibly under pressure as part of a conventional process for casting sanitary wares 8 not described further in the specification.

To allow alternation between the open and closed positions, at least one of the platens 3 or 4 is translatable in a longitudinal direction "O" along slide ways 9 afforded by the bed 2.

The moving platen 3 or 4 is traversed toward and away from the stationary platen 4 or 3 by means of conventional embodiment not shown in the drawings.

The initial movement of the demolding step is made by the translatable platen 3 or 4. Thereafter, the casting 8 can be released by positioning the mold in the manner most convenient for the type of sanitary ware in production, or the type of process adopted; the demolding operation can be manual, or power-assisted, or completely automated.

Figure 2:
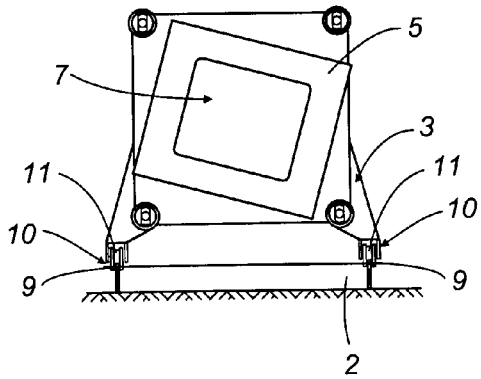
FIG. 2 shows the mold half and the relative platen on the right of the single mold machine of FIG. 1, viewed in a front elevation.

In the examples illustrated, the moving platen is the platen 3 on the right as seen in FIG. 1 and in FIGS. 4–9, and shown also in FIG. 2, and accordingly, equipped with slide means 10 which in turn comprise wheels 11 rolling on the ways 9.

Figure 3:
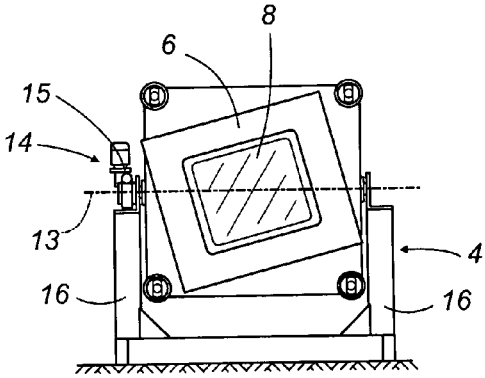
FIG. 3 shows the mold half and the relative platen on the left of the single mold machine of FIG. 1, viewed in a front elevation.
Figure 4:
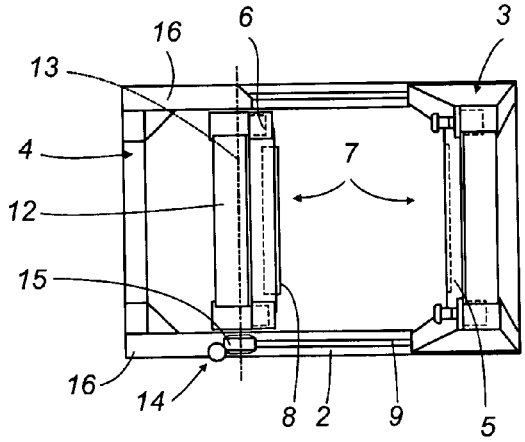
FIG. 4 illustrates the single mold machine of FIGS. 1–3 in a view from above.

The remaining platen 4;3 is stationary, relative to the aforementioned longitudinal direction "O". In the examples illustrated, the stationary platen 4 is the platen on the left as seen in FIG. 1 and in FIGS. 4–9, and shown also in FIG. 3.

More precisely, the stationary platen 4 consists in a fixed frame 16 carrying a tilting platen 12, to which the mold half 6 is mounted. The tilting platen 12 is pivotable relative to the frame 16 about an axis 13 disposed substantially horizontal and perpendicular to the longitudinal direction "O".

The tilting movement of the platen 12 is brought about through the agency of rotary drive means 14, indicated by way of example as a geared electric motor 15.

Naturally enough, the tilting movement might be induced by any suitable drive means: mechanical, hydraulic, pneumatic, etc.

A tilting platen 12 consequently ensures ease of access to the mold half 6, which can be positioned according to the particular process and demolding requirements for the sanitary wares in production.

To facilitate positioning and accessibility, the frame 16 is split into two parts, thereby allowing freedom of access to the two mold halves 5 and 6 and to the casting 8 both from the side nearer to the moving platen 3 and from the side opposite.

FIGS. 5 to 8 illustrate certain configurations occurring typically during production.

Figure 5:
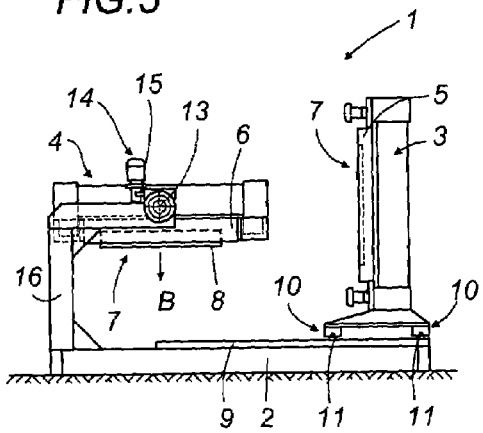
FIGS. 5, 6 and 7 are side elevations showing the single mold machine in the open configuration, with the mold half on the left occupying different positions.

FIG. 5 shows the tilting platen 12 rotated 90° and facing downwards, so that the casting 8 can be removed in the direction denoted "B".

This solution is particularly advantageous in the case of relatively thin sanitary wares, like shower bases for example, which do not readily withstand the bending and torsional stresses liable to occur in the course of the demolding step.

In particular, the casting 8 can be demolded directly onto a horizontal surface, or a roller table (not illustrated).

Figure 6:
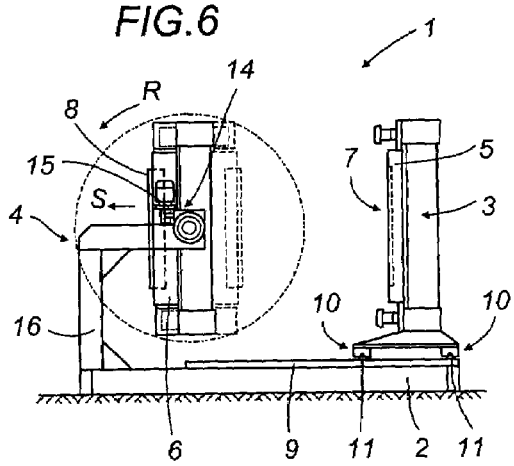

FIG. 6 shows the tilting platen 12 rotated 180° approximately. The platen 12 will rotate preferably in the direction denoted "R" (see FIG. 6) so as to ensure the casting 8 is not directed downwards at any point during the rotation.

In this instance the casting 8 can be released and demolded toward the left, observing FIG. 6, in the direction denoted "S".

This solution is especially advantageous in the case of sanitary wares such as flushing cisterns, which for particular technological reasons are best demolded in a position upended from the pressure casting position.

Figure 7:
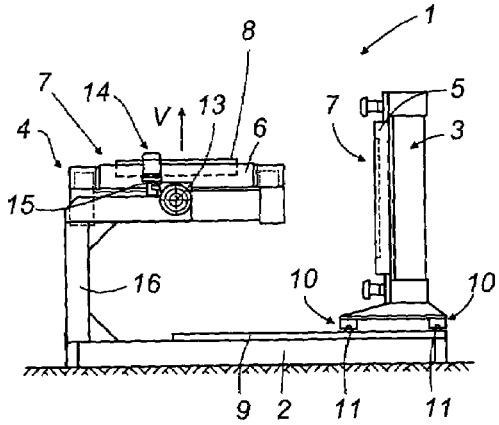

FIG. 7 shows the tilting platen 12 rotated 90° and facing upwards, so that the casting 8 can be removed from above in the direction denoted "V".

Figure 10:
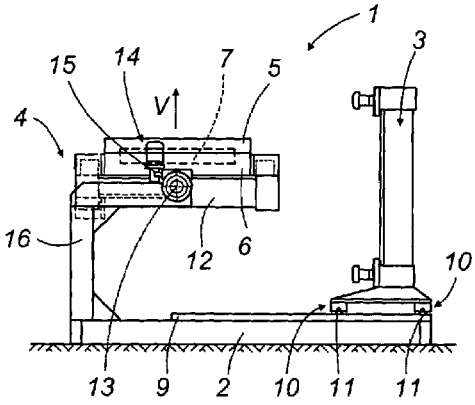
FIG. 10 is a further side elevation showing the single mold machine in the open configuration and illustrating a step of changing over the mold.

FIG. 10 shows a step of removing the two mold halves 5 and 6 by raising them vertically in the direction denoted "V".

In these two examples, the positioning of the platen 12 is particularly advantageous in that it allows the casting 8 to be demolded, or the mold halves 5 and 6 themselves to be removed, typically with the aid of a hoist or a fork lift truck.

With this facility in mind, it will be observed also that the top part of the machine 1 according to the invention is completely devoid of structural components that could hinder these operations. As discernible clearly from the drawings, in effect, both platens 3 and 4 are anchored to the bed 2 and supported from the bottom.

This said, the lower area between the platens 3 and 4 is similarly free of structural components, so that the bed 2 can be built into the bearing surface under the machine 1, if convenient, with the ways 9 positioned at floor level.

To advantage, an arrangement of this type will allow the use of mobile lifting equipment such as small hoists, pallet trucks, robots and the like, which can be inserted between the two platens 3 and 4 for the purpose of fitting and removing the mold halves and/or demolding the green castings.

Figure 9:
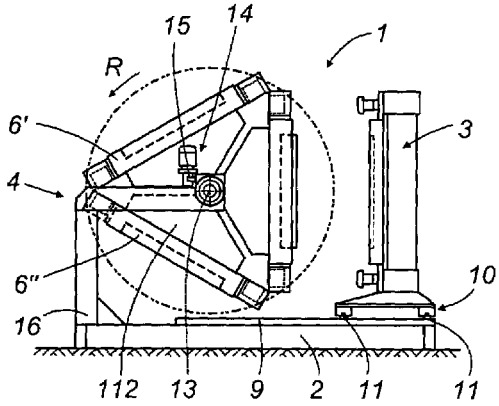

FIGS. 8 and 9 show two alternative embodiments of the machine 1 according to the invention.

FIG. 8 illustrates a tilting platen 12 capable of carrying a second mold half 6' mounted to the face opposite from that carrying the mold half 6 already mentioned.

This configuration can be adopted when there are no particular technological requirements dictating that the casting 8 must be released from the mold in a given vertical or horizontal position.

In the event that the two mold halves 6' and 6 are identical, they can be alternated in such a manner that one item of sanitary ware 8 is cast in one of the rotatable halves while another item is demolded from the other rotatable half.

Once the moving platen 3 has been distanced from the tilting platen 12, and the casting 8 released from the translatable mold half 5, the platen 12 can be rotated through 180° to bring the new, empty mold half 6' into a position facing the moving platen 3 and the corresponding mold half 5.

Accordingly, as one casting 8 is being released from the one mold half 6 carried by the platen 12, another item can be cast utilizing the other mold half 6'.

This has the effect of increasing output, since a further item of sanitary ware can be cast without waiting for the previous casting to be demolded.

Moreover, the two alternating mold halves 6 and 6' can be dissimilar, while both matching the mold half 5 carried by the moving platen 3, so that the machine is able to manufacture two different types of sanitary ware in tandem.

The tilting platen 12 can also be used to effect a fast mold changeover, according to the method that will now be described.

Assuming two first mold halves 5 and 6 to be fitted to the relative platens 3 and 12, the method according to the invention comprises the steps of:

fitting a second mold, consisting in two second mold halves 5' and 6' joined one to another by mechanical connection means, to the free face of the tilting platen 12;

traversing the moving platen 3 toward the tilting platen 12, in such a way that the two halves 5 and 6 of a first mold are offered one to the other;

joining the two first mold halves 5 and 6 one to another by way of mechanical connection means;

detaching the first mold half 5 from the moving platen 3;

rotating the tilting platen 12 through 180° in such a manner as to bring the first mold into a position allowing its removal;

traversing the moving platen 3 toward the tilting platen 12, so as to offer the selfsame platen 3 to the corresponding half 5' of the second mold;

securing the second mold half 5' to the moving platen 3;

separating the two halves 5' and 6' of the second mold by unfastening the mechanical connection means;

detaching the first mold halves 5 and 6 from the tilting platen 12.

Given that the halves 5 and 6 of the first mold can be removed during the course of the subsequent casting cycle, the changeover can be effected in extremely quick time, and in any event within an interval of time covered by the duration of the casting cycle for one item of sanitary ware 8.

FIG. 9 shows a further alternative embodiment of the stationary platen 4 in which the frame 16 carries a tilting platen 112 affording three faces, two of which able to carry respective mold halves denoted 6' and 6". Likewise in this instance it becomes possible to demold the castings or change the molds without any need for the manufacturing cycle to be interrupted.

The invention affords important advantages.

Using the machine disclosed, sanitary wares can be demolded and transferred with ease to further manufacturing steps, by virtue of the fact that the tilting platen 12 is free to rotate.

The especially favorable degree of access to the mold halves 5 and 6 and the casting 8 is connected with the fact that the translational and rotational movements are split between the two mold platens 3 and 4. With the frame 16 of the stationary platen 4 divided into two parts, for example, the machine guarantees ease of access to the tilting platen 12 and the relative mold half 6, even from the rear.

Access is facilitated similarly by the overall structure of the machine 1, which has no overhead structural elements and is designed with a bed 2 that can be sunk completely into the floor.

Accordingly, the time needed to free the castings from the mold halves is advantageously reduced, as also is the time taken to change the molds.

In the alternative solutions of FIGS. 8 and 9, the replacement of the mold halves is speeded up further thanks to the facility of carrying out the mold change operation during the casting cycle.

What is claimed is:

1. A single mold machine for pressure casting sanitary wares, comprising a bed having a substantially longitudinal direction, a first and a second platen associated with the bed, two mold half supported respectively by the first and second platen, said first platen being translatable relative to the bed along the substantially longitudinal direction, and the second platen comprising a frame divided into two parts; each of said two parts being "L" shaped and comprising a first end portion directly constrained to the bed and a second end portion suspended from the bed and extending towards the first platen; the second platen further comprising a tilting platen carrying one of said two mold half; said tilting platen being placed between said two parts of the frame and being rotatable connected to said second end portions of the two parts, for rotating about an axis substantially horizontal and extending perpendicular to the longitudinal direction; said bed comprising sliding means for sliding said first platen along the substantially longitudinal direction, the sliding means being associated to the bed and the first platen being supported from the bottom by the bed.

2. A single mold machine as in claim 1, wherein the second platen is supported from the bottom by the bed and includes rotating means for rotating said tilting platen, said second platen being stationary relative to the bed.

3. A single mold machine as in claim 1, wherein the tilting platen comprises at least two surfaces, each supporting one mold half.

4. A single mold machine as in claim 1, wherein said sliding means comprise ways associated with the bed, also wheels associated with the translatable platen and running on the ways.

5. A single mold machine as in claim 1, wherein the bed is sunk into a bearing surface under the machine whereby an unrestricted access to a space between the platens is provided.

6. A single mold machine as in claim 1, wherein said tilting platen is rotatable about its rotating axis through 360 degrees.

7. A single mold machine as in claim 6, comprising drive means for rotating said tilting platen; said drive means being selected from the group of electric, hydraulic, pneumatic, or mechanical drive means.

8. A single mold machine as in claim 7, wherein the drive means comprises a geared electric motor.

9. A single mold machine as in claim 1, wherein said tilting platen completely extends between said two parts of the frame.

10. A single mold machine for pressure casting sanitary wares, comprising a bed having at least a substantially longitudinal direction, a first and a second platen associated with the bed, two mold half supported respectively by the first and second platen, said first platen being translatable relative to the bed along said at least substantially longitudinal direction, and the second platen comprising a frame divided into two parts; each of said two parts being "L" shaped and comprising a first end portion directly constrained to the bed and a second end portion suspended from the bed and extending towards the first platen; the second platen further comprising a tilting platen carrying one of said two mold half said tilting platen being placed between said two parts of the frame and being rotatable connected to said second end portions of the two parts, for rotating about an axis substantially horizontal and extending perpendicular to the longitudinal direction; said bed comprising sliding means for sliding said first platen along said at least substantially longitudinal direction, the sliding means being associated to the bed and the first platen being supported from the bottom by the bed.

* * * * *